United States Patent [19]

Muise

[11] 4,432,491

[45] Feb. 21, 1984

[54] CONTAINER PACKAGING FOR CUPS

[75] Inventor: Herbert D. Muise, Orange, Calif.

[73] Assignee: Weyerhaeuser Company, Tacoma, Wash.

[21] Appl. No.: 390,713

[22] Filed: Jun. 21, 1982

[51] Int. Cl.[3] ..... B65D 5/22; B65D 5/42

[52] U.S. Cl. ..... 229/33

[58] Field of Search ..... 229/33, 31 FS, 26, 36, 229/34 R

[56] References Cited

U.S. PATENT DOCUMENTS 3,581,973 6/1971 Turpin ..... 229/49

*Primary Examiner*—Herbert F. Ross

[57] ABSTRACT

A container structure in which there are notches in the upper edges of the end walls or in which the end walls are shorter than the side walls to accommodate product holding rails.

6 Claims, 7 Drawing Figures

CONTAINER PACKAGING FOR CUPS

BACKGROUND OF THE INVENTION

1. Field of the Invention

A container.

2. Summary of the Invention

The purpose of the present invention is to devise a container which allows automatic filling of the container with cups. The present container allows this. Rails hold the cups by the rims or any point along the cups depth that will allow the cups to be supported by the rails. The container is raised upwardly until the cups are in the container and rest on the base of the container. The rails fit into slots in the end walls of the container. The container is then moved horizontally. The cups are carried with the container and move along and off the rails. Instead of slots in the end walls, the height of the end walls may be shorter than the side walls or the cups.

BRIEF DESCRIPTION OF THE DRAWINGS

The FIG. 1 is a top plan view of a blank for the tray.

DESCRIPTION OF THE PREFERRED EMBODIMENT

Figure 1:
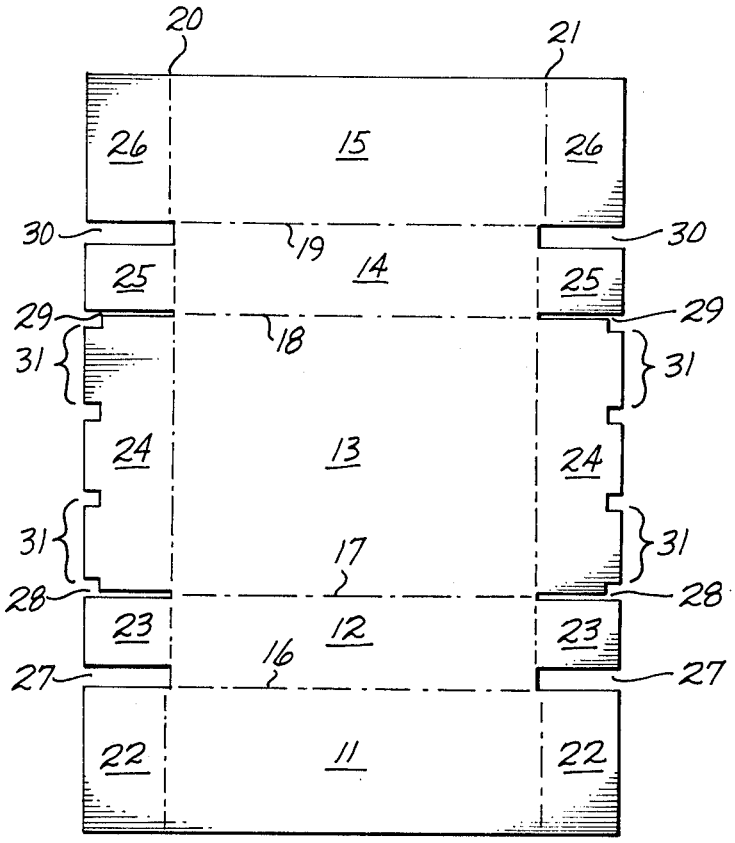
Figure 2:
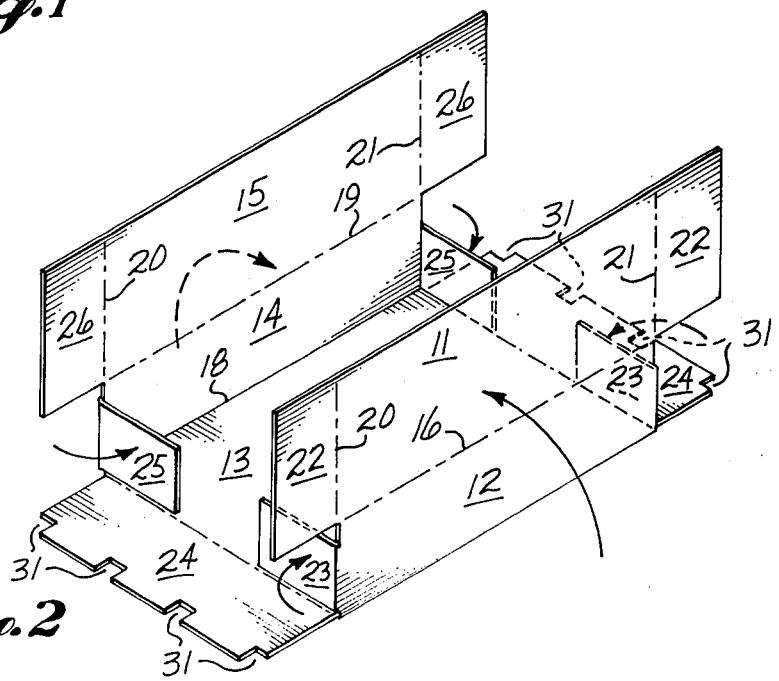
FIGS. 2–5 are views showing the formation of the tray.

The container shown and described is a tray.

The blank 10 is divided into a first cover panel 11, a first side panel 12, a bottom panel 13, a second side panel 14 and a second cover panel 15 by parallel score lines 16, 17, 18, and 19 respectively. Score lines 20 and 21 define the side edges of these panels.

These same score lines 20 and 21 also are the hinged attachments of the end flaps and panels to panels 11–15. First end closure panels 22 are attached to the ends of first cover panel 11. First end flaps 23 are attached to the ends of first side panel 12. End panels 24 are attached to the ends of bottom panel 13. Second end flaps 25 are attached to the ends of second side panel 14, and second end closure panels 26 are attached to the ends of second cover panel 15. Slots divide the end panels and flaps from each other—slot 27 separating first end closure panel 22 from first end flap 23; slot 28 separating first end flap 23 from end panel 24; slot 29 separating end panel 24 from second end flap 25; and slot 30 separating second end flap 25 from second end closure panel 26. The slots are aligned with score lines 16–19.

Notches 31 are formed in the outer edge of end panels 24. The notches 31 in one end panel are aligned with the notches 31 in the opposite end panel. The number and placement of these notches 31 will depend on the number of cups and size of cups being placed in the container. The notch configuration shown will accommodate three rows of cups in the container. Rails hold the cups by the rims or any point along the cups depth that will allow the cups to be supported by the rails. The rails fit into the notches 31.

Figure 6:
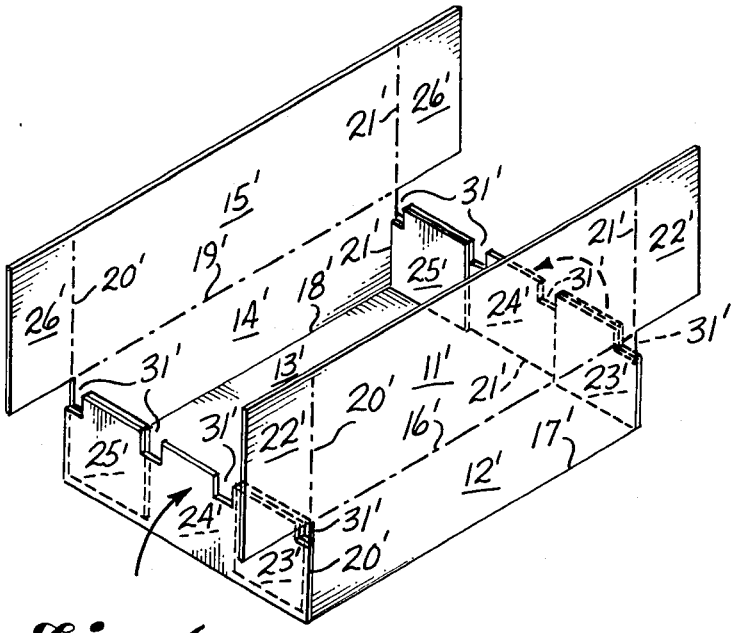
FIGS. 6 and 7 are isometric views showing two modifications of the container.

The end flaps 23 and 25 are shorter than side panels 12 and 14 so that the upper edge of the end flaps 23 and 25 will be beneath the notches 31 in the formed container. The maximum height of the end flaps is equal to the distance between said bottom closure and the bottom of said notches. It is also possible for the end flaps 23 and 25 to be the same height as the end panels 24 and the side panels 12 and 14, and for the end flaps 23 and 25 to have notches in their upper edges which would mate with the notches 31 in end panels 24 as shown in FIG. 6.

Figure 7:
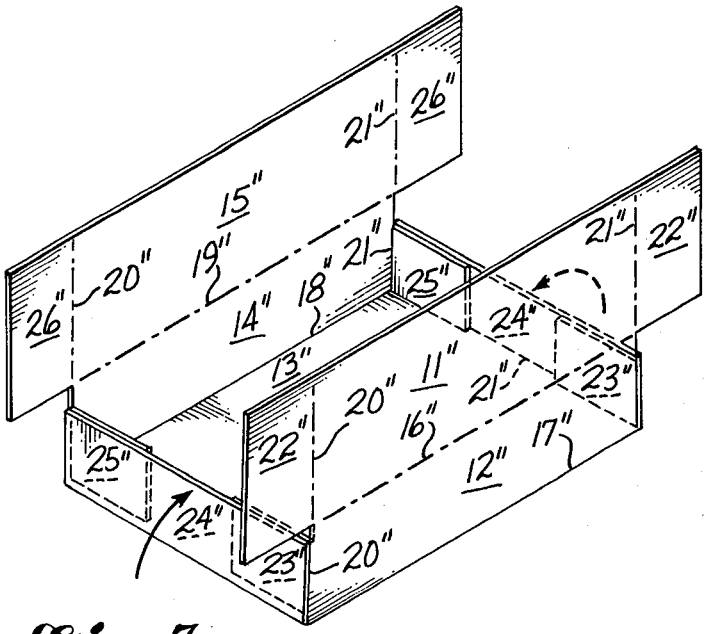

It is also possible to make the end panels 24 shorter than side panels 12 and 14 so they would be the same height as flaps 23 and 25 are in FIG. 1. No notches would then be needed in the end panels. This is shown in FIG. 7.

In any of these constructions the distance between the bottom panel 13 and the upper edge of end panel 24 or flaps 23 and 25 if no notches are used, or between the bottom panel 13 and the lower edge of the notches 31 in the end panels 24 or flaps 23 and 25 if notches are used is equal to or slightly less than the distance between the base of the cup and the lower edge of the rails. Whether notches are used will depend upon the strength needed in the end walls. If greater stacking strength is required, then the end panels 24 and even the end flaps 23 and 25 will extend the height of the container.

The trays are formed by bending the side panels 12 and 14 upwardly around score lines 17 and 18 respectively until they are at right angles to the bottom panel 13. The end flaps 23 and 25 are bent inwardly until they are aligned with the inner side of score lines 20 and 21 on the bottom panel 13. End panels 24 are bent upwardly around score lines 20 and 21 and adhered to the flaps 23 and 25. As will be seen in FIG. 3 the notches 31 extend above the upper edge of end flaps 23 and 25. In one modified configuration the end flaps 23 and 25 would extend to the upper edge of end panels 24 and the upper edge of the end flaps 23 and 25 would have notches corresponding to the notches 31 in the end panels 24. In another modified configuration the upper edge of end panels 24 would be aligned with the upper edges of end flaps 23 and 25 and these flaps and panels would be shorter than side panels 12 and 14.

Figure 3:
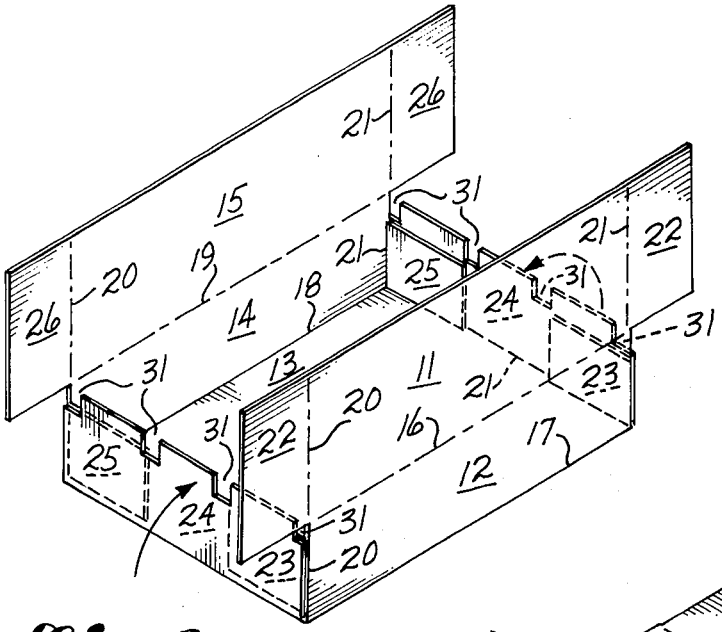
Figure 4:
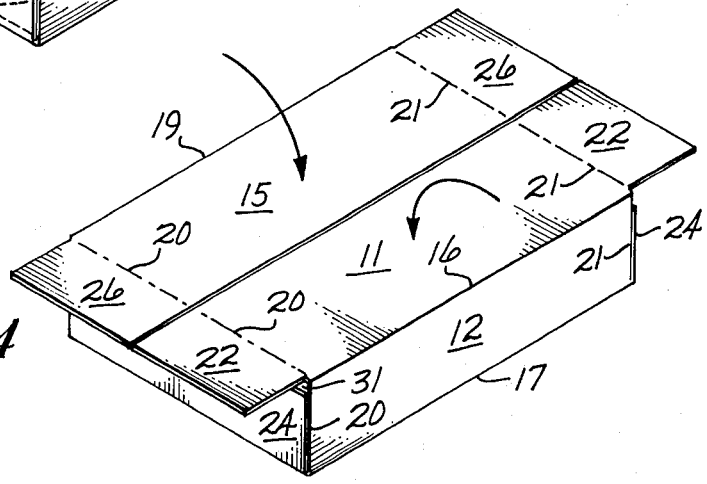
Figure 5:
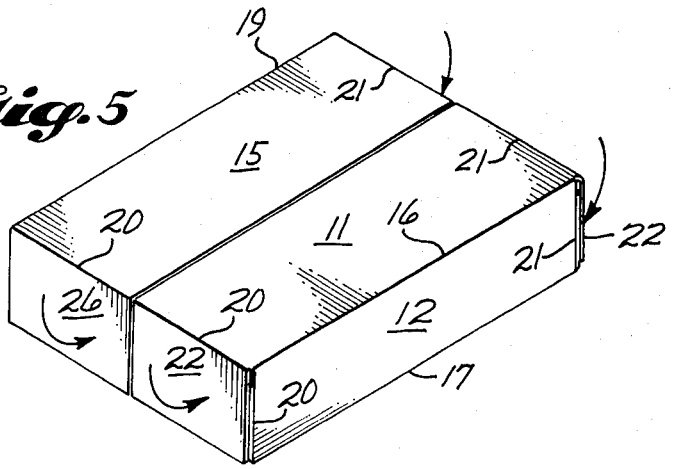

The container shown in FIG. 3 may now be filled by raising it upwardly around the cups hanging from parallel rails. When the container is in its uppermost position the cups are resting on the bottom panel 13 and the rails are within the notches 31. The container is then moved horizontally with the notches 31 sliding along the rails. The cups are carried horizontally along the rails by the container. After the container leaves the rails the cover panels 11 and 15 are bent downwardly around score lines 16 and 19 and the end closure panels 22 and 26 are bent downwardly and adhered to end panels 24 to form the finished container. The product is now completely enclosed and there are no notches showing in the outer walls of the container.

Although a tray is shown, the container may be a bliss container or a modified regular slotted container having cover and end closure flaps which are the same as those shown. It may also be formed of a two ply bottom panel, one ply being attached to the end panels and the other ply attached to the side panels. It may also have a self-closing bottom closure which is formed into place when the container is set up.

I claim:

1. A container for packaging cups comprising side panels, a bottom closure, end panels extending between said side panels, notches in the upper edges of said end panels to accommodate rails holding said cups, said notches in one end panel being aligned with said notches in the other end panel, two of said notches in each end panel being at the upper corners of said end panel, the remainder of said notches in each end panel being located equidistantly across the top edge of said end panel, the distance between said notches being substantially greater than the width of said notches, said notches having a width which allows said rails to fit into said notches, cover panels hingedly attached to said side panels, closure panels hingedly attached to the sides of said cover panels, said closure panels being fastenable to the outer face of said end panels covering said notches.

2. The container of claim 1 further comprising end flaps attached to the sides of said side panels, said end flaps being attached to said end panels, said end flaps having a maximum height equal to the distance between said bottom closure and the bottom of said notches.

3. The container of claim 1 further comprising end flaps attached to the sides of said side panels, said end flaps being attached to the end panels, said end flaps having notches in their upper edges which are aligned with said notches in said end panels.

4. A blank for a container for packaging cups comprising side panels, a bottom panel attached to said side panels, end panels attached to said bottom panel, said end panels being of substantially the same height as said side panels, notches in the upper edges of each of said end panels to accommodate rails holding said cups, said notches in one end panel being aligned with said notches in the other end panel, two of said notches in each of said end panels being at the upper corners of said end panels, the remainder of said notches in each end panel being located equidistantly across the upper edge of said end panel, the distance between said notches being substantially greater than the width of said notches, said notches having a width which allows said rails to fit into said notches, cover panels hingedly attached to said side panels, closure panels hingedly attached to the sides of said cover panels, the distance between said hinged attachment of said closure panel and the outer edge of said closure panel being greater than the depth of said notches.

5. The blank of claim 4 further comprising end flaps attached to the sides of said side panels, said end flaps having a maximum height equal to the distance between said bottom panel and the bottom of said notches.

6. The blank of claim 4 further comprising end flaps attached to the sides of such side panels, said end flaps having notches in their upper edges which are aligned with said notches in the end panels in said container.

* * * * *